US011066204B2

(12) United States Patent
Pedercini et al.

(10) Patent No.: US 11,066,204 B2
(45) Date of Patent: Jul. 20, 2021

(54) APPARATUS FOR APPLYING SELF-ADHESIVE LABELS

(71) Applicant: SACMI VERONA S.P.A., Imola (IT)

(72) Inventors: Maurizio Pedercini, Marmirolo (IT); Matteo Grioni, Curtatone (IT)

(73) Assignee: SACMI VERONA S.P.A., Imola (IT)

( * ) Notice: Subject to any disclaimer, the term of this patent is extended or adjusted under 35 U.S.C. 154(b) by 157 days.

(21) Appl. No.: 16/341,732

(22) PCT Filed: Oct. 19, 2017

(86) PCT No.: PCT/EP2017/076696
§ 371 (c)(1),
(2) Date: Apr. 12, 2019

(87) PCT Pub. No.: WO2018/073338
PCT Pub. Date: Apr. 26, 2018

(65) Prior Publication Data

US 2020/0087014 A1 Mar. 19, 2020

(30) Foreign Application Priority Data

Oct. 19, 2016 (IT) ..... 102016000104810

(51) Int. Cl.
*B65C 9/18* (2006.01)
*B65C 9/00* (2006.01)
*B65C 3/16* (2006.01)

(52) U.S. Cl.
CPC ..... *B65C 9/1869* (2013.01); *B65C 3/16* (2013.01); *B65C 9/1892* (2013.01);
(Continued)

(58) Field of Classification Search
CPC . B65C 9/1869; B65C 3/16; B65C 2009/0096; B65C 9/1892;
(Continued)

(56) References Cited

U.S. PATENT DOCUMENTS 5,188,696 A 2/1993 Good, Jr.
7,404,275 B2 * 7/2008 Stenner ..... B65C 9/00 156/DIG. 12
2010/0038034 A1 2/2010 Bittner

FOREIGN PATENT DOCUMENTS

CN 201376693 Y 1/2010
CN 202987646 U 6/2013
(Continued)

OTHER PUBLICATIONS

International Search Report dated Nov. 7, 2017 re: Application No. PCT/EP2017/076696, pp. 1-4, citing: EP 1 712 475 A1, WO 97/13645 A1, US 2010/038034 A1 and U.S. Pat. No. 5,188,696 A.
(Continued)

*Primary Examiner* — Mark A Osele
*Assistant Examiner* — Christopher C Caillouet
(74) *Attorney, Agent, or Firm* — Cantor Colburn LLP

(57) ABSTRACT

An apparatus for applying self-adhesive labels includes a supporting base for at least one reel of a ribbon that supports self-adhesive labels, elements of feeding the ribbon to a head for applying the self-adhesive labels, and a device for taking up the ribbon. The application head can move on command about an orientation axis in order to vary its own direction of extension with respect to the unwinding direction of the ribbon from the reel. The feeder elements include at least one redirection roller, the rotation axis of which can rotate on command, with respect to the reel, about an adjustment axis that is substantially parallel to the orientation axis in order to bring the direction of extension of the ribbon at the application head.

4 Claims, 7 Drawing Sheets

(52) U.S. Cl.
CPC . *B65C 2009/0096* (2013.01); *Y10T 156/1317* (2015.01); *Y10T 156/1702* (2015.01); *Y10T 156/1705* (2015.01); *Y10T 156/1707* (2015.01)

(58) Field of Classification Search
CPC ..... Y10T 156/1317; Y10T 156/1702; Y10T 156/1705; Y10T 156/1707
See application file for complete search history.

(56) References Cited

FOREIGN PATENT DOCUMENTS

| | | | |
|---|---|---|---|
| CN | 205010600 | U | 2/2016 |
| EP | 1712475 | A1 | 10/2006 |
| WO | 9713645 | A1 | 4/1997 |

OTHER PUBLICATIONS

IT Search Report dated Jun. 8, 2017 re: Application No. IT 2016000104810, pp. 1-7, citing: EP 1 712 475 A1, WO 97/13645 A1, US 2010/038034 A1 and U.S. Pat. No. 5,188,696 A.
Written Opinion dated Nov. 7, 2017 re: Application No. PCT/EP2017/076696, pp. 1-7, citing: EP 1 712 475 A1.

* cited by examiner

APPARATUS FOR APPLYING SELF-ADHESIVE LABELS

TECHNICAL FIELD

The present disclosure relates to an apparatus for applying self-adhesive labels, particularly on containers.

BACKGROUND

The application of self-adhesive labels on containers, such as for example bottles, is typically carried out using a labeling assembly constituted by a structure for supporting one or more reels on which a backing ribbon of self-adhesive labels to be applied is wound: the backing ribbon is unwound from the reel and fed to an application head that has a substantially blade-like end portion that is designed to arrange itself, in use, flanking and substantially parallel to the region of application of the label on the container.

The backing ribbon is then taken up and sometimes wound on a takeup reel.

In some cases it is necessary to apply the self-adhesive labels on planes that are inclined with respect to the vertical, for example at the neck of the bottle and, as a consequence, it is necessary to incline the blade-like end portion of the application head.

The solutions known today entail that, in order to incline the application head with respect to the vertical, the labeling assembly be made to rotate with respect to a support footing.

This evidently brings about a variation in the height of the feed reel: for the purposes of example, if the labels need to be applied on necks that are particularly inclined with respect to the vertical, the feed reel is brought to an appreciably higher level than the normal level while, if the region of application is directed downward, the height of the feed reel is lowered, approaching the floor.

It therefore seems clear that, in some conditions of use, some problems arise in that, owing to the excessive raising of the height of the feed reel, it becomes difficult and occasionally risky for the operators to intervene on it, for example in order to change the reel.

If instead it is necessary to apply labels at negative cones, then bringing the reel closer to the floor causes some problems such as, for example, the possibility that parts of the labeling assembly might interfere with portions of the footing, making it, among other things in some cases, difficult for the operator to gain access to some parts of the labeling machine.

SUMMARY

The aim of the present disclosure is to provide an apparatus for applying self-adhesive labels which is capable of improving the known art in one or more of the above mentioned aspects.

Within this aim, the disclosure provides an apparatus for applying self-adhesive labels that makes it possible to adjust the inclination of the application head in an easy and practical manner.

The disclosure also provides an apparatus for applying self-adhesive labels that is highly reliable, easy to implement and low cost.

This aim and these and other advantages which will become better apparent hereinafter are achieved by providing an apparatus for applying self-adhesive labels according to claim 1, which is optionally provided with one or more of the characteristics of the dependent claims.

BRIEF DESCRIPTION OF THE DRAWINGS

Further characteristics and advantages of the disclosure will become better apparent from the description of some preferred, but not exclusive, embodiments of the apparatus for applying self-adhesive labels according to the disclosure, which are illustrated for the purposes of non-limiting example in the accompanying drawings wherein.

DETAILED DESCRIPTION OF THE DRAWINGS

Figure 1:
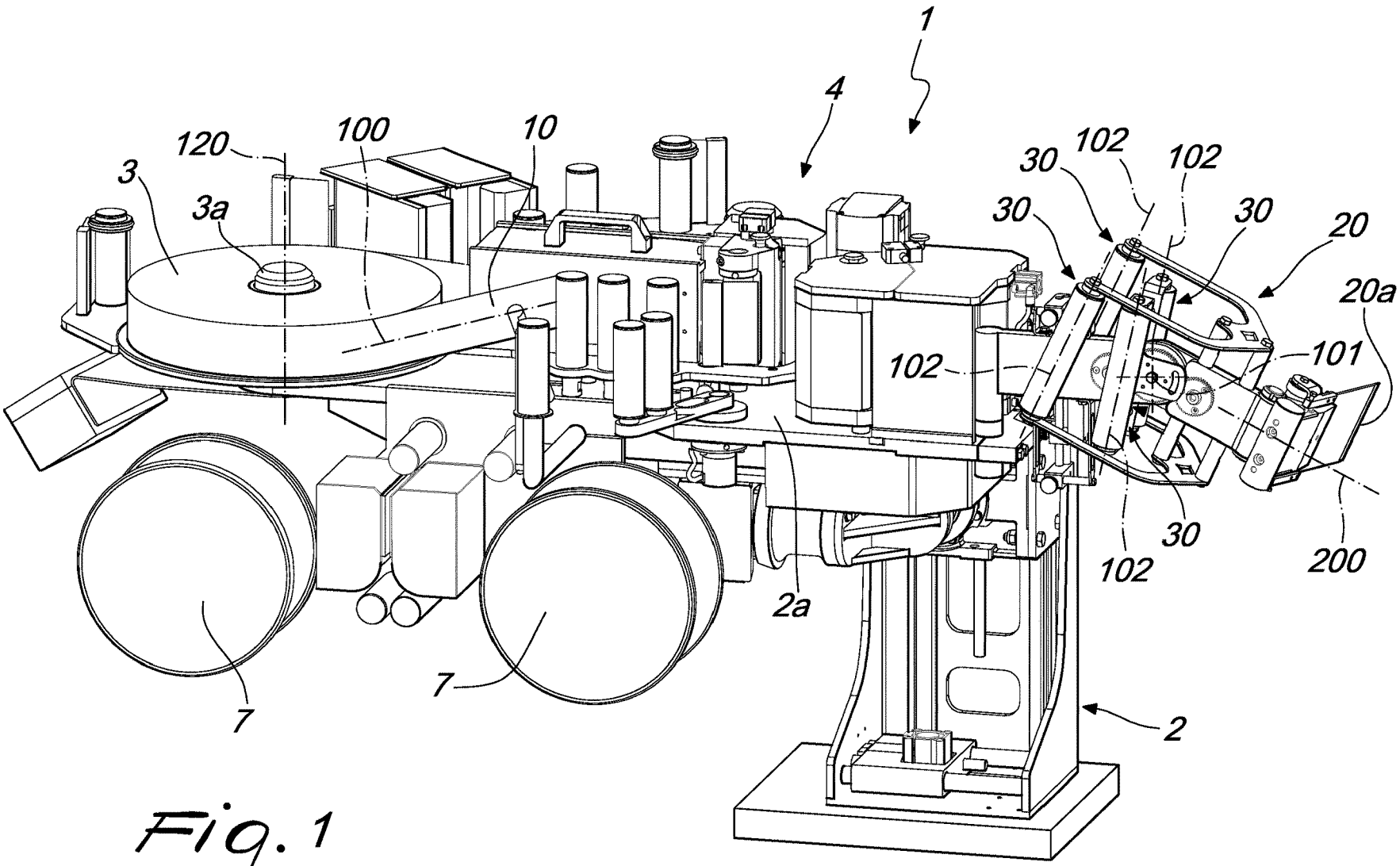
FIG. 1 is a perspective view of an apparatus for applying self-adhesive labels according to the disclosure.
Figure 2:
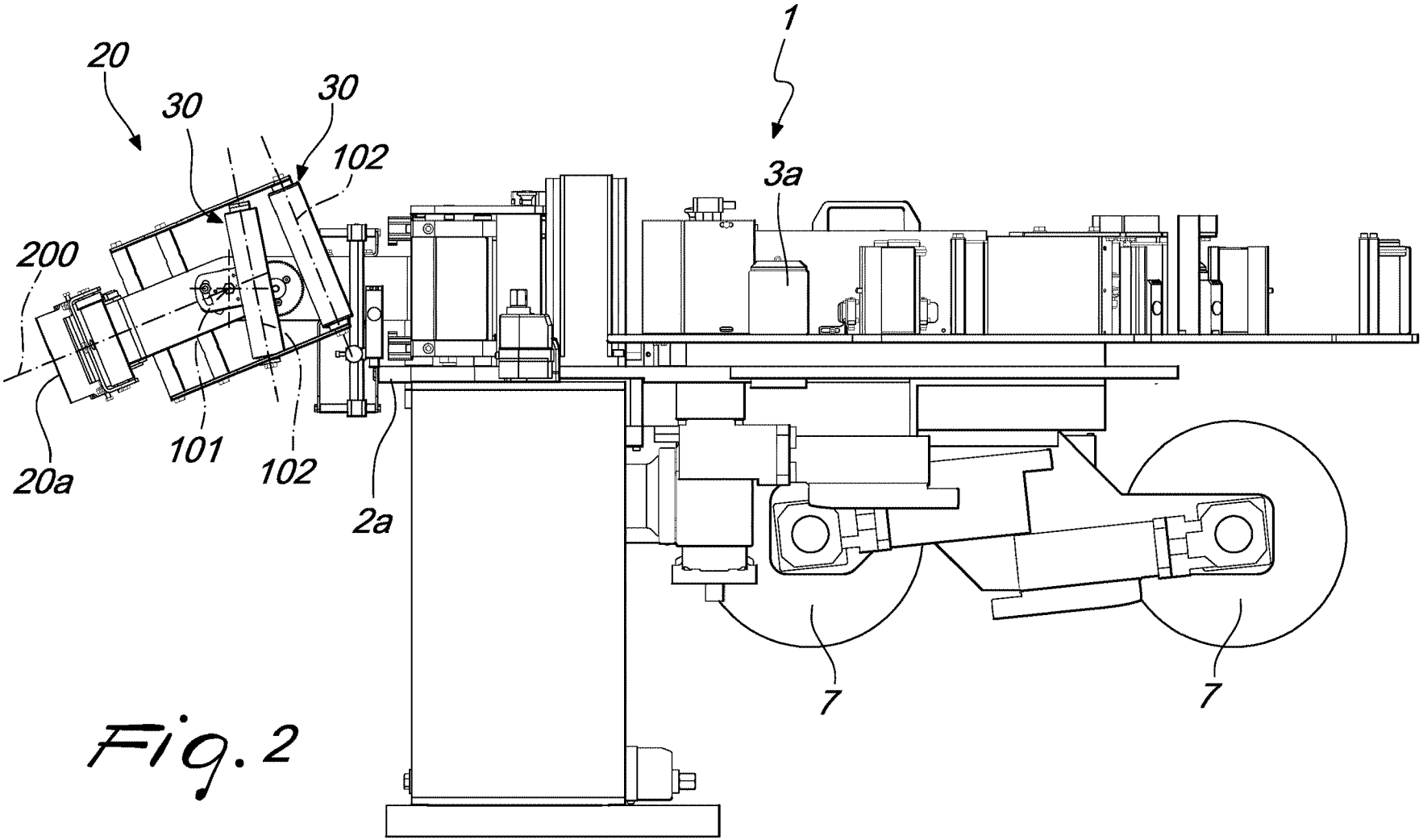
FIG. 2 is a side view of the apparatus of FIG. 1.
Figure 3:
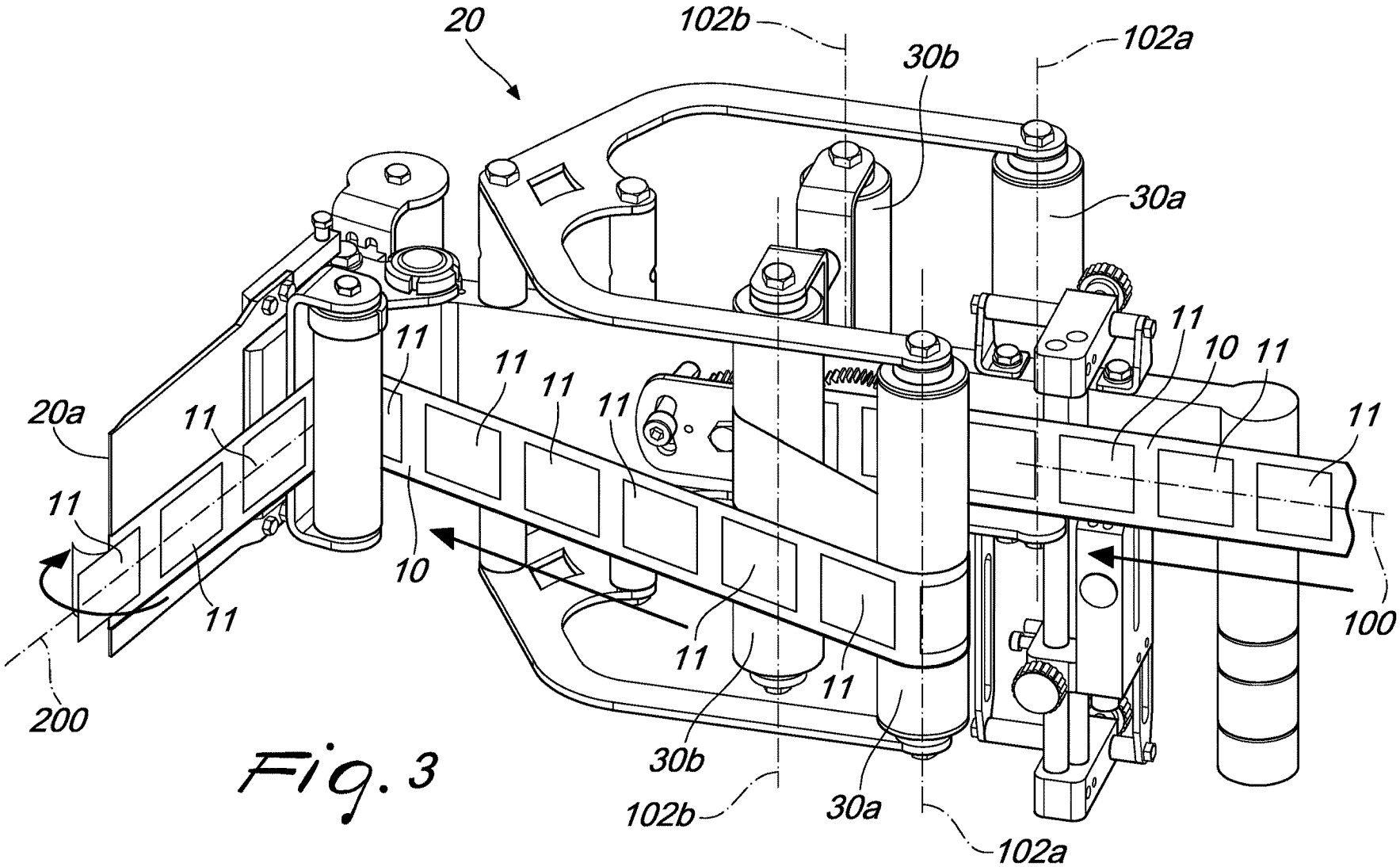
FIG. 3 is a perspective view of the application head associated with the ribbon supporting the self-adhesive labels.

With reference to FIGS. 1-7, the apparatus for applying self-adhesive labels according to the disclosure, generally designated by the reference numeral 1, comprises a supporting base 2 for at least one reel 3 on which a ribbon 10 that supports a plurality of self-adhesive labels 11 is wound.

The apparatus 1 is provided with means 4 of feeding the ribbon 10 to a head 20 for applying the self-adhesive labels 11.

The apparatus 1 is further provided with a device for taking up the ribbon 10.

The takeup device can, for example, comprise at least one rewinding reel 7.

The application head 20 extends along a direction of extension 200 that defines a path direction for the ribbon 10.

According to the present disclosure, the application head 20 can move on command about an orientation axis 101 in order to vary its own direction of extension 200 with respect to the unwinding direction 100 of the ribbon 10 from the feed reel 3.

The feeder means 4 comprise, furthermore, at least one redirection roller 30 the longitudinal axis 102 of which can rotate on command, with respect to the reel 3, about an adjustment axis that is substantially parallel to the orientation axis 101 in order to bring the direction of extension of the ribbon 10 at the application head 20 substantially parallel to the direction of extension 200 of the application head 20.

Advantageously, the application head 20 can move on command about the orientation axis 101 with respect to a supporting body 2*a* of the reel or reels 3.

For the purposes of example, the supporting body 2*a* of the reel or reels 3 comprises a supporting plate.

According to a preferred embodiment, the feeder means 4 comprise at least two redirection rollers 30*a*, 30*b* the longitudinal axes 102*a*, 102*b* of which can rotate on command, with respect to the reel 3, about a respective adjustment axis that is substantially parallel to the orientation axis 101.

The reel or reels 3 are advantageously associated with a reel carrier 3*a*.

Conveniently, the adjustment axis of the redirection roller or rollers 30 corresponds substantially to the orientation axis 101.

Conveniently, at least one redirection roller 30 is supported by the application head 20.

With reference to the embodiment shown in the figures, the feeder means comprise at least two redirection rollers 30*a*, 30*b*, and in particular an end roller 30*a* the rotation axis 102*a* of which is arranged substantially at right angles to the direction of extension 200 of the application head 20, and at least one intermediate roller 30*b* arranged upstream of the end roller 30*a* with respect to the advancement direction of the ribbon 10.

The rotation axis 102*b* of the intermediate roller 30*b* has an intermediate position of extension between the axis 120 of the reel 3 on which the ribbon 10 is wound, and the rotation axis 102*a* of the end roller 30*a*.

Advantageously the end roller 30*a* is supported integrally by the application head 20 so that the rotation of the application head 20 about the orientation axis 101 rotationally entrains, by the same angle, the rotation axis 102*a* of the end roller 30*a* as well.

The apparatus 1 is conveniently provided with means 5 of kinematic connection between the application head 20 and the above-mentioned at least one intermediate roller 30*b*.

In particular, the kinematic connection means 5 are adapted to determine, as a consequence of the rotation of the application head 20 about the orientation axis 101, a rotation of substantially halved extent of the rotation axis 102*b* of the intermediate roller 30*b* about the respective adjustment axis.

If there are more than two redirection rollers 30, and therefore at least two intermediate rollers 30*b* in addition to the end roller 30*a*, then it should be noted that the sum of all the inclinations of the rotation axes 102*b* of the intermediate rollers 30*b* must be substantially equal to half the extent of the inclination of the longitudinal axis 102*a* of the end roller 30*a* about the respective adjustment axis.

With reference to the embodiment shown in the figures, the intermediate roller or rollers 30*b* are supported by a supporting block that can rotate on command about the orientation axis 101.

The operation of the apparatus 1 according to the disclosure is evident from the foregoing description.

Figure 4:
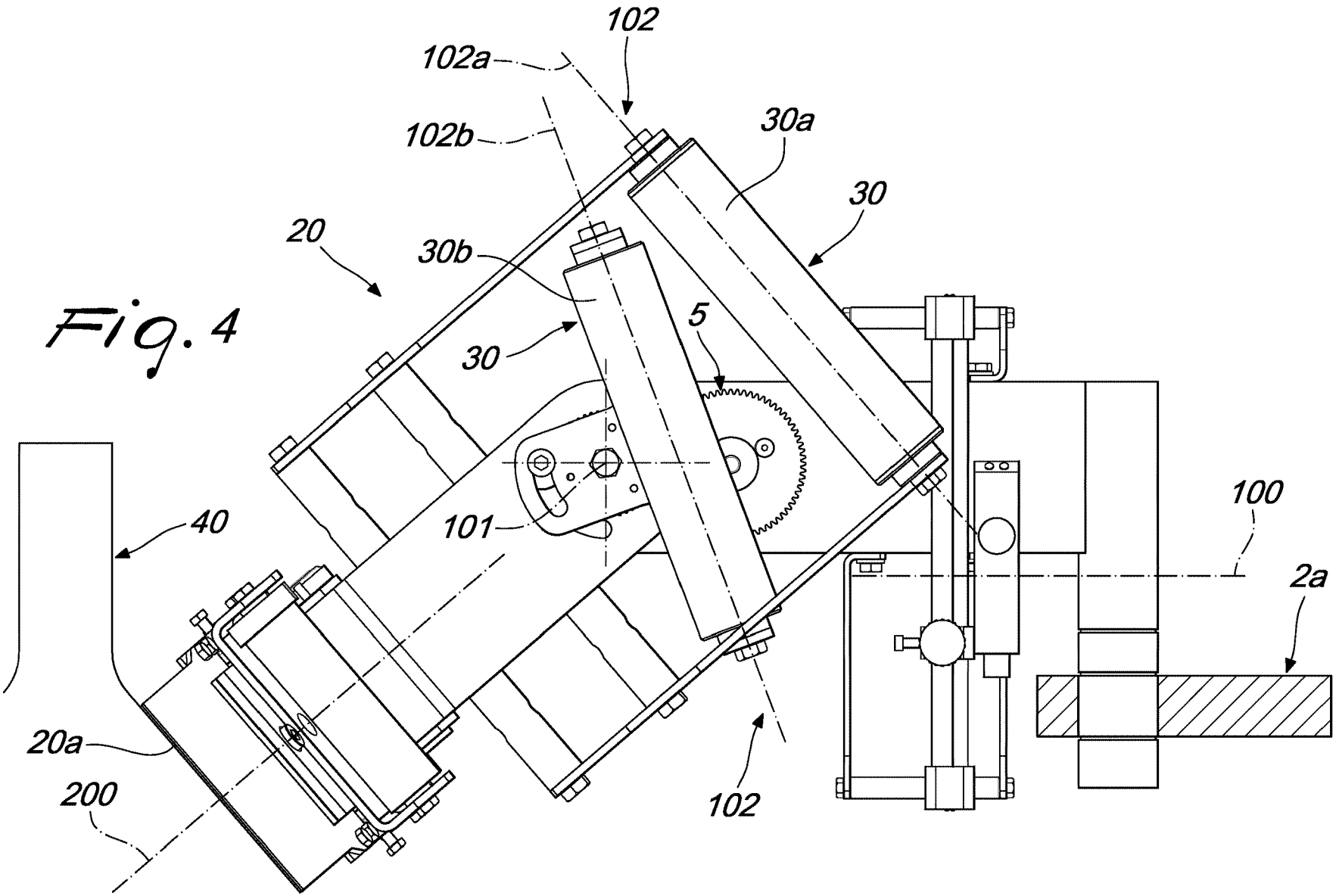
FIG. 4 is a side view of the application head in a first active condition.
Figure 5:
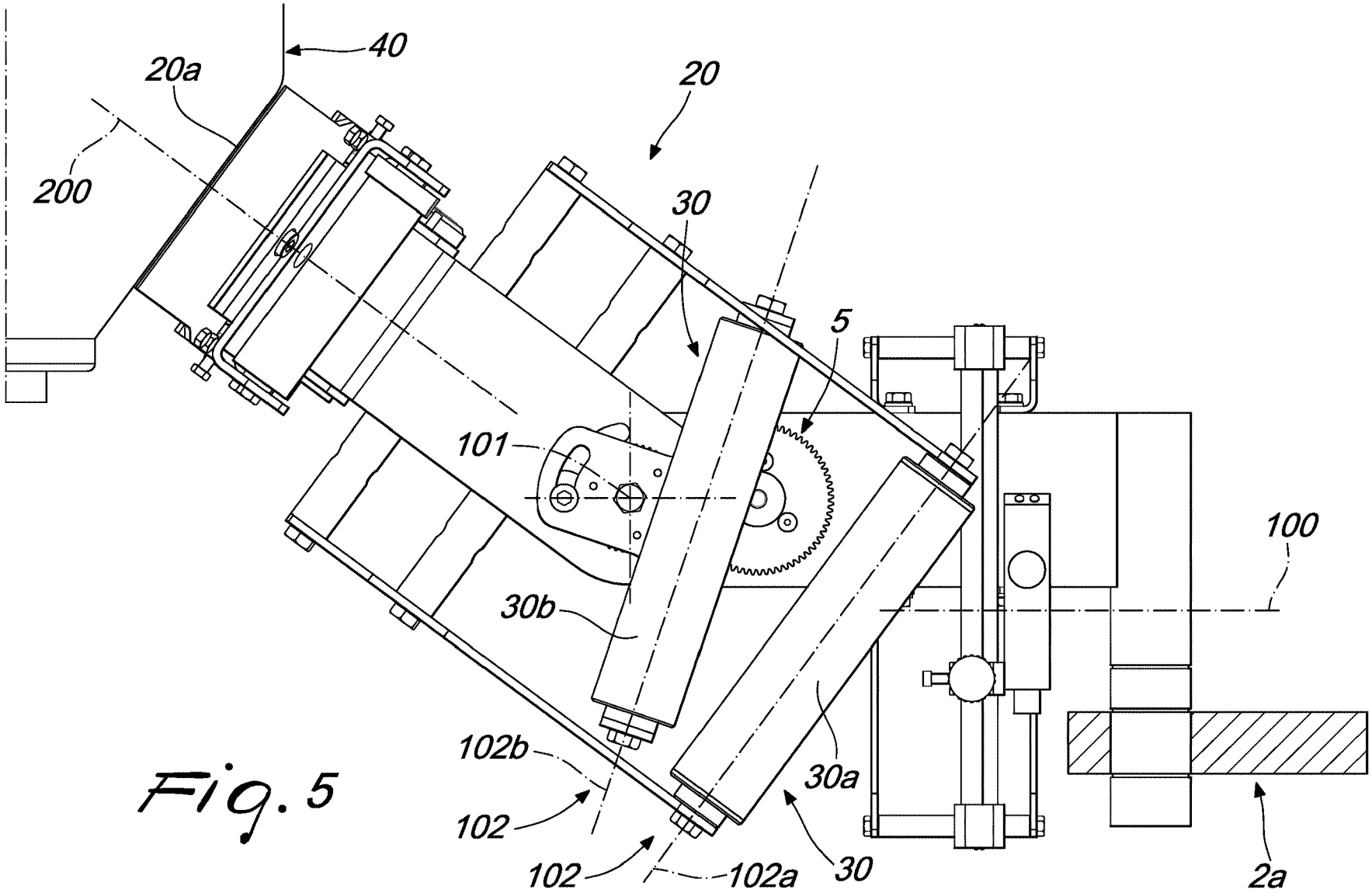
FIG. 5 is a side view of the application head in a second active condition.
Figure 6:
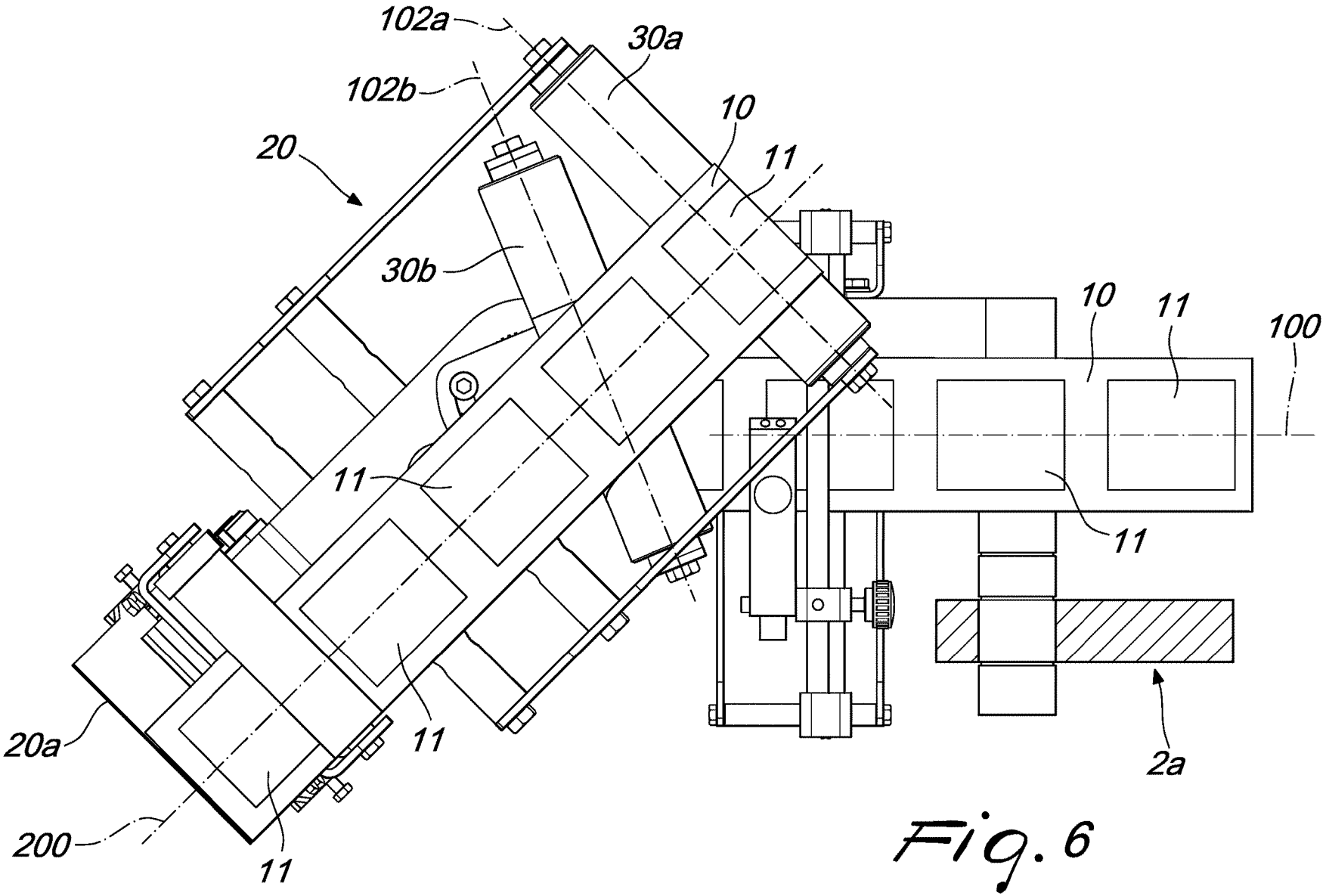
FIG. 6 is a side view of the application head in the first active condition associated with the ribbon supporting the self-adhesive labels.
Figure 7:
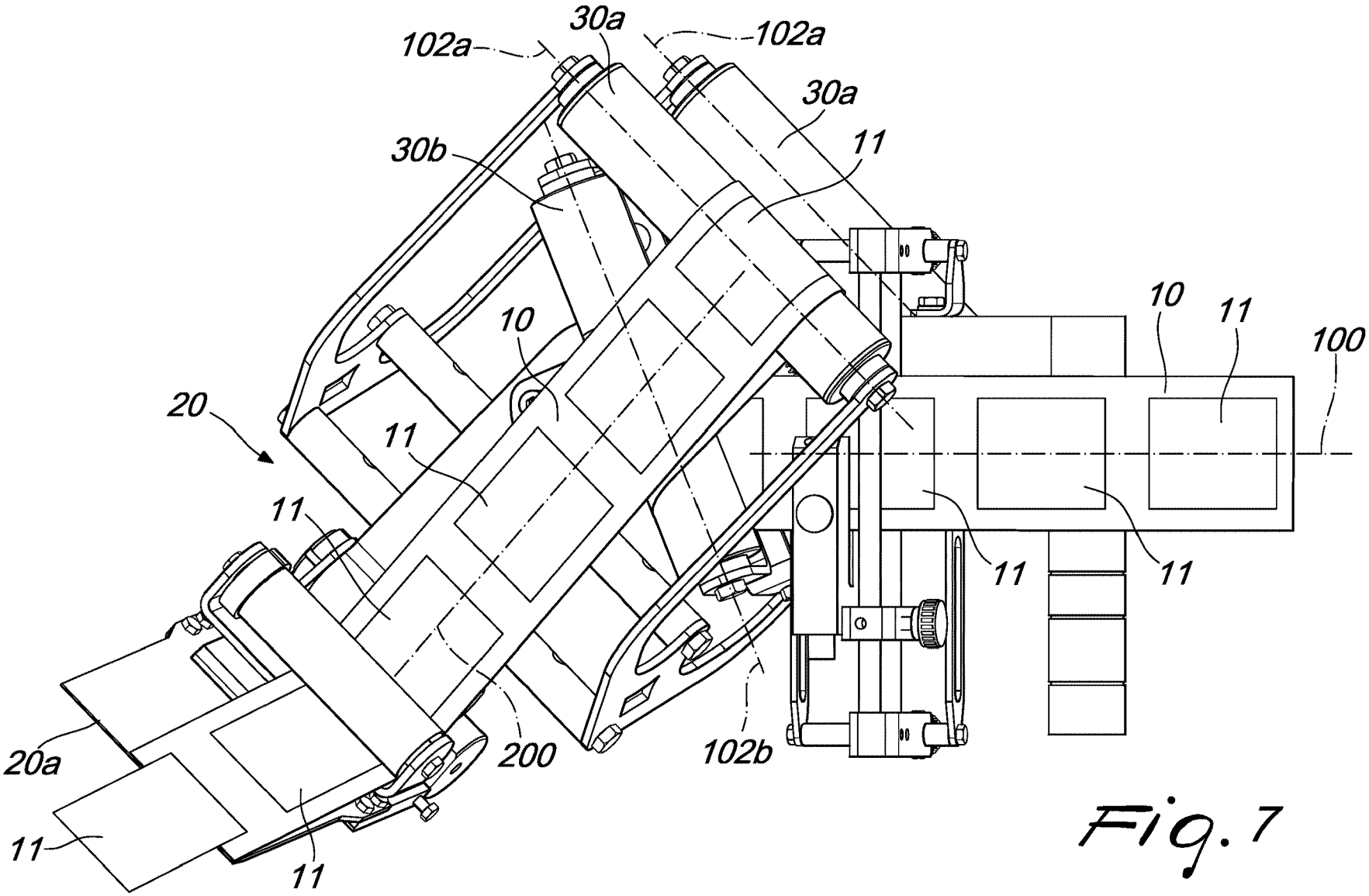
FIG. 7 is a perspective view of the application head in the condition shown in FIG. 6.

The proposed solution makes it possible to position the application head 20 optimally both for application with "positive" angles (as shown in FIG. 4) if it is necessary to label the necks of the containers 40 or to apply stickers, bands, collars etc., or with "negative" or reverse angles (as shown in FIG. 5) in situations where it is necessary to carry out the application of the labels at the base of the container 40 when this is narrower than the shoulder.

In order to bring the ribbon 10 to the application head 20 so that its extension is always parallel to the direction of extension 200 of the application head 20 proper, one or preferably at least two redirection rollers 30 are therefore used, the longitudinal axes 102 of which are rotatable, with respect to the direction of extension 100 of the ribbon unwound from the reel 3.

By virtue of the possible presence of the kinematic connection means 5, the apparatus is self-aligning: in practice, as the inclination of the application head 20 varies (i.e. as a consequence of the rotation of the application head 20 about the orientation axis 101), the intermediate roller 30*b*, connected mechanically to the application head 20, assumes an angle such as to favor the redirection of the ribbon 10 while keeping the alignment of the actual ribbon 10 with the peeler blade 20*a* of the application head 20.

All this makes it possible to be able to make the peeler blade 20*a*, and as a consequence the label, assume multiple inclinations while keeping the supporting body 2*a* and therefore also the feed reel 3 horizontal.

This makes it possible to always have the supporting body 2*a* at zero inclination (i.e. flat), thus facilitating operations by the operator such as loading the ribbon, preparing the joints and taking out the material, and making any operations necessary to restart after a machine shutdown easier, more convenient and rapid.

It is in any case possible that the supporting body 2*a* of the reel or reels 3 can move on command with respect to the supporting structure 2, and in particular with respect to a footing.

Specifically, according to requirements, it can be possible to raise and/or lower the supporting body 2*a* with respect to the supporting structure 2.

Furthermore, there is no reason why the supporting body 2*a* should not be able to rotate on command with respect to the supporting structure 2 about an axis of inclination substantially parallel to the orientation axis 101. This makes it possible, in some particular active conditions, to "share" the absolute inclination of the application head 20, partially on the supporting body 2*a* (which is inclined with respect to the horizontal) and partially on the application head 20 (which is also inclined with respect to the supporting body 2*a*).

For applying labels on cylindrical surfaces, or more generally on vertical surfaces, the application head 20 can obviously assume the horizontal position, optionally also bypassing the redirection rollers 30.

In practice it has been found that the disclosure fully achieves the intended aims and advantages.

The disclosure thus conceived is susceptible of numerous modifications and variations, all of which are within the scope of the appended claims. Moreover, all the details may be substituted by other, technically equivalent elements.

In practice, the materials used, as well as the contingent shapes and dimensions, may be any according to the requirements and to the state of the art.

The disclosures in Italian Patent Application No. 102016000104810 (UA2016A007460) from which this application claims priority are incorporated herein by reference.

The invention claimed is:

1. An apparatus for applying self-adhesive labels comprises:

a supporting base for at least one reel of a ribbon that supports a plurality of self-adhesive labels, means of feeding said ribbon to a head for applying said self-adhesive labels, and a device for taking up said ribbon, said application head extending along a direction of extension that defines a path direction for the ribbon, wherein said application head can move on command about an orientation axis in order to vary its own direction of extension with respect to the unwinding direction of said ribbon from said reel, said feeder means comprising at least two redirection rollers, which are supported by said application head and the longitudinal axes of which can rotate on command, with respect to said supporting body, about a respective adjustment axis that is substantially parallel to said orientation axis, said at least two redirection rollers comprising an end roller, which is supported by said application head and has a rotation axis thereof arranged substantially at right angles to the direction of extension of said application head, and at least one intermediate roller arranged upstream of said end roller with respect to the advancement direction of said ribbon, the rotation axis of said intermediate roller having an intermediate position between the axis of said reel on which said ribbon is wound and the rotation axis of said end roller, the apparatus further comprising means of kinematic connection between said application head and said at least one intermediate roller.

2. The apparatus according to claim 1, wherein said application head can move on command about said orientation axis with respect to a supporting body of said at least one reel.

3. The apparatus according to claim 1, wherein said kinematic connection means are adapted to determine, following the rotation of said application head about said orientation axis, a rotation of substantially halved extent of the rotation axis of said intermediate roller about the respective adjustment axis.

4. The apparatus according to claim 1, wherein said at least one intermediate roller is supported by a supporting block that can rotate on command about said orientation axis.

* * * * *